US008312735B2

(12) United States Patent
Fulton

(10) Patent No.: US 8,312,735 B2
(45) Date of Patent: Nov. 20, 2012

(54) EXTERNAL TILT BUCKET FOR AN APPLIANCE DOOR

(75) Inventor: Timothy A. Fulton, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 762 days.

(21) Appl. No.: 12/402,535

(22) Filed: Mar. 12, 2009

(65) Prior Publication Data

US 2009/0229284 A1 Sep. 17, 2009

Related U.S. Application Data

(60) Provisional application No. 61/035,775, filed on Mar. 12, 2008.

(51) Int. Cl.
*F25C 5/00* (2006.01)
*F25C 5/18* (2006.01)

(52) U.S. Cl. ..... 62/344; 62/135; 62/137; 62/377

(58) Field of Classification Search ..... 62/135, 62/137, 344, 377; 222/146.6
See application file for complete search history.

(56) References Cited

U.S. PATENT DOCUMENTS

| | | | | |
|---|---|---|---|---|
| 2,656,688 | A | 10/1953 | Hinkel | |
| 3,055,184 | A * | 9/1962 | Linstromberg | 62/137 |
| 3,218,111 | A | 11/1965 | Steiner | |
| 3,561,231 | A | 2/1971 | Webb | |
| 3,602,007 | A * | 8/1971 | Drieci | 62/344 |
| 3,635,043 | A | 1/1972 | Sterling | |
| 4,306,757 | A * | 12/1981 | Horvay et al. | 312/292 |
| 6,050,097 | A | 4/2000 | Nelson et al. | |
| 6,148,624 | A * | 11/2000 | Bishop et al. | 62/137 |
| 6,442,954 | B1 | 9/2002 | Shapiro et al. | |
| 2007/0113578 | A1 * | 5/2007 | Wu et al. | 62/344 |
| 2008/0041090 | A1 * | 2/2008 | Lee et al. | 62/344 |

FOREIGN PATENT DOCUMENTS

| | | | |
|---|---|---|---|
| EP | 1482263 | A2 | 12/2004 |
| EP | 1559973 | A1 | 8/2005 |
| EP | 1653176 | A2 | 5/2006 |
| EP | 1788329 | A2 | 5/2007 |
| WO | 2008/020723 | A1 | 2/2008 |

* cited by examiner

*Primary Examiner* — Cheryl J Tyler
*Assistant Examiner* — Jonathan Bradford
(74) *Attorney, Agent, or Firm* — Kirk W. Goodwin; Price Heneveld LLP

(57) ABSTRACT

A door assembly for an appliance includes a door having an interior side and an exterior side. The door is operable between an open position and a closed position. An ice maker is adjacent to the interior side of the door when the door is in the closed position. A frame defines an aperture extending from the interior side to the exterior side. An ice bucket is disposed in the aperture and is operable between a lowered position, wherein a reservoir portion of the bucket is accessible when the door is closed, and a raised position, wherein the reservoir portion of the bucket is inaccessible when the door is closed. An ice dispenser is disposed below the ice bucket.

16 Claims, 4 Drawing Sheets

EXTERNAL TILT BUCKET FOR AN APPLIANCE DOOR

CROSS-REFERENCE TO RELATED APPLICATIONS

This application claims priority under 35 U.S.C. §119(e) to U.S. Provisional Patent Application No. 61/035,775, entitled "REFRIGERATOR WITH SPACE MANAGEMENT MODULES," filed on Mar. 12, 2008, the entire disclosure of which is hereby incorporated herein by reference.

BACKGROUND OF THE PRESENT INVENTION

The present invention generally relates to a door assembly for a refrigerator and, more specifically, to an outwardly tilting ice bucket for a refrigerator.

SUMMARY OF THE INVENTION

In one aspect of the present invention, a door assembly for an appliance includes a door having an interior side and an exterior side. The door is operable between an open position and a closed position. An ice maker is adjacent to the interior side of the door when the door is in the closed position. A frame defines an aperture extending from the interior side to the exterior side. An ice bucket is disposed in the aperture and is operable between a lowered position, wherein a reservoir portion of the bucket is accessible when the door is closed, and a raised position, wherein the reservoir portion of the bucket is inaccessible when the door is closed. An ice dispenser is disposed below the ice bucket.

In another aspect of the present invention, a refrigerator includes a refrigerating section and a freezing section. A door is hingedly connected to the refrigerator and is operable between an open position and a closed position. An ice maker is disposed inside the refrigerating section. An ice bucket is operably coupled with the door, wherein the ice bucket receives ice from the ice maker and is accessible when the door is in the closed position.

In yet another aspect of the present invention, a module for a refrigerator includes an ice maker. A tilt-out ice bucket is rotatably connected with an external side of the refrigerator below the ice maker. The tilt-out ice bucket includes a bottom wall with an ice hatch disposed therein. An ice dispenser includes an actuator operably connected with and disposed below the ice hatch and adapted to receive ice from the tilt-out ice bucket upon engagement of the actuator.

These and other features, advantages and objects of the present invention will be further understood and appreciated by those skilled in the art upon studying the following specification, claims, and appended drawings.

DETAILED DESCRIPTION OF EMBODIMENTS

Figure 1:
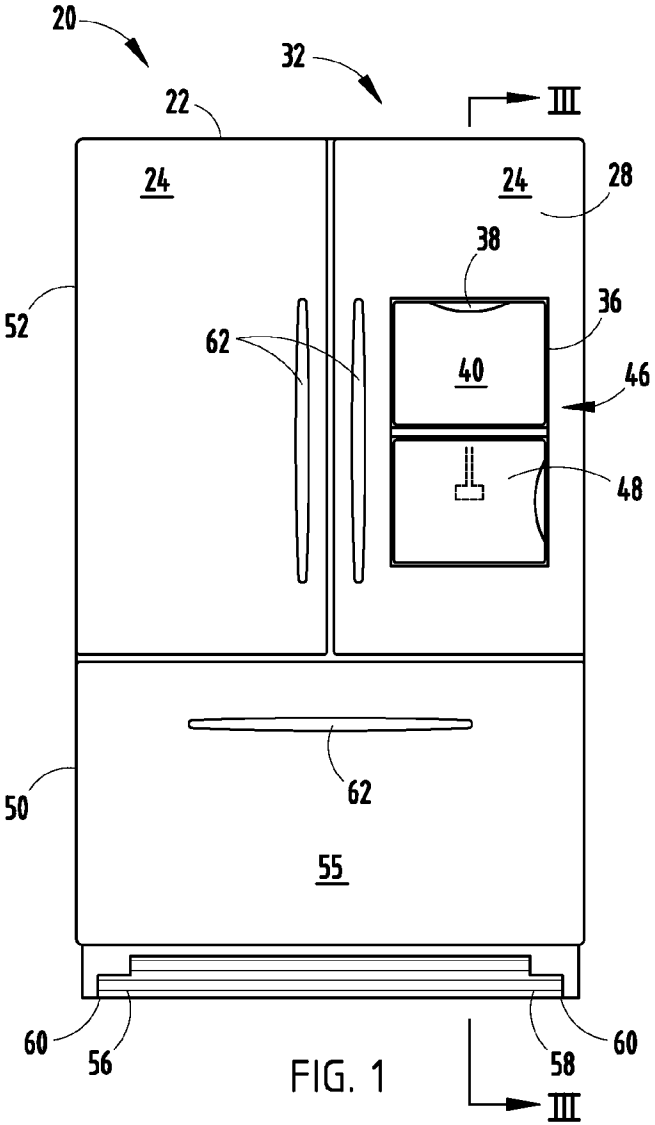
FIG. 1 is a front elevational view of a refrigerator incorporating one embodiment of the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
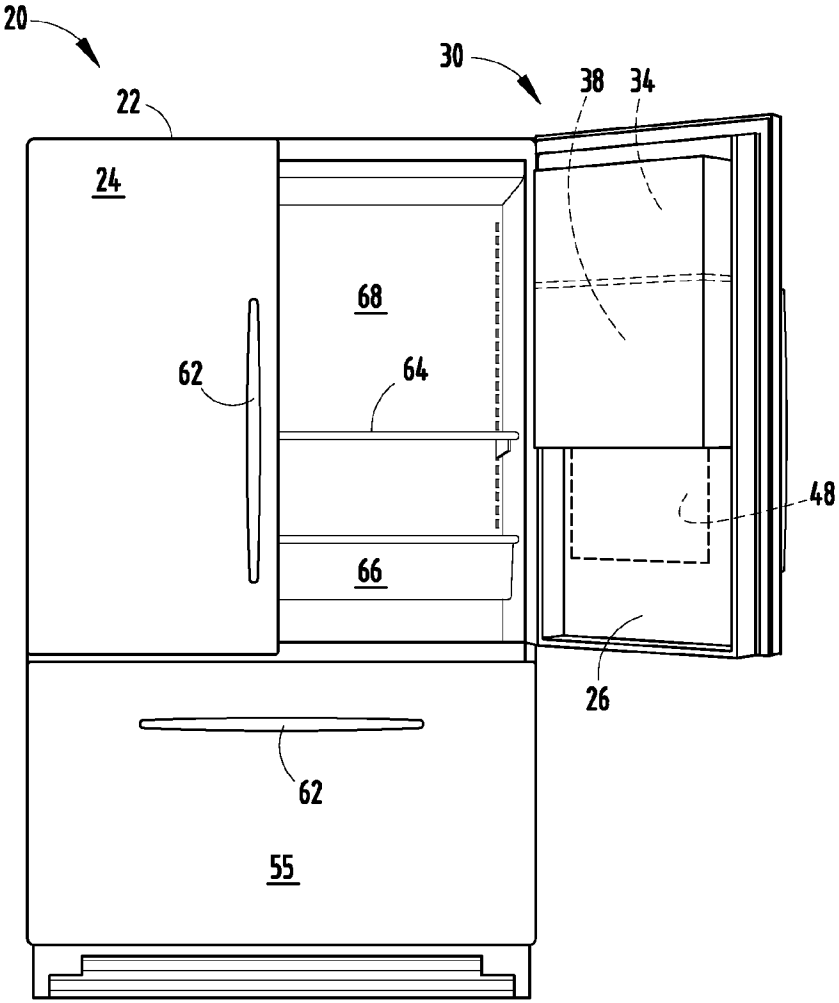
FIG. 2 is a front elevational view of the refrigerator of FIG. 1 with the refrigerator door open.

The reference numeral 20 shown in FIGS. 1 and 2 generally designates a door assembly for an appliance 22 having a door 24 with an interior side 26 and an exterior side 28. The door 24 is operable between an open position 30 and a closed position 32. An ice maker 34 is adjacent to the interior side 26 of the door 24 when the door 24 is in the closed position 32. A frame 36 defines an aperture 38 extending from the interior side 26 to the exterior side 28. An ice bucket 40 is disposed in the aperture 38 and is operable between a lowered position 42 (FIG. 5), wherein a reservoir portion 44 (FIG. 3) of the bucket 40 is accessible when the door 24 is in the closed position 32 and a raised position 46, wherein the reservoir portion 44 of the bucket 40 is inaccessible when the door 24 is in the closed position 32. An ice dispenser 48 is disposed below the ice bucket 40. An ice hatch 49 regulates movement of ice from the ice maker 34 to the ice bucket 40.

Referring again to FIGS. 1 and 2, the door 24 of the present invention may be incorporated in a variety of refrigerator 22 designs. Specifically, the refrigerator 22 may include multiple refrigerator compartments or freezer compartments arranged horizontally or vertically. The refrigerator shown in FIGS. 1 and 2 includes a lower freezer section 50 and an upper refrigerator section 52 with outwardly opening refrigerator doors 24 disposed above a freezer door 55 on the freezer section 50. A vent 56 is positioned on a bottom portion 58 of the refrigerator 22 adjacent refrigerator supports 60, and handles 62 are disposed on each of the refrigerator and freezer doors 24, 55 to assist a user in opening and closing the refrigerator and freezer doors 24, 55. As shown in FIG. 2, the refrigerator 22 may include a variety of organizing elements, such as shelves 64 and bins 66. The organizing elements 64, 66 may be located on the refrigerator door 24 as well as in a cabinet portion 68 of the refrigerator 22.

Figure 4:
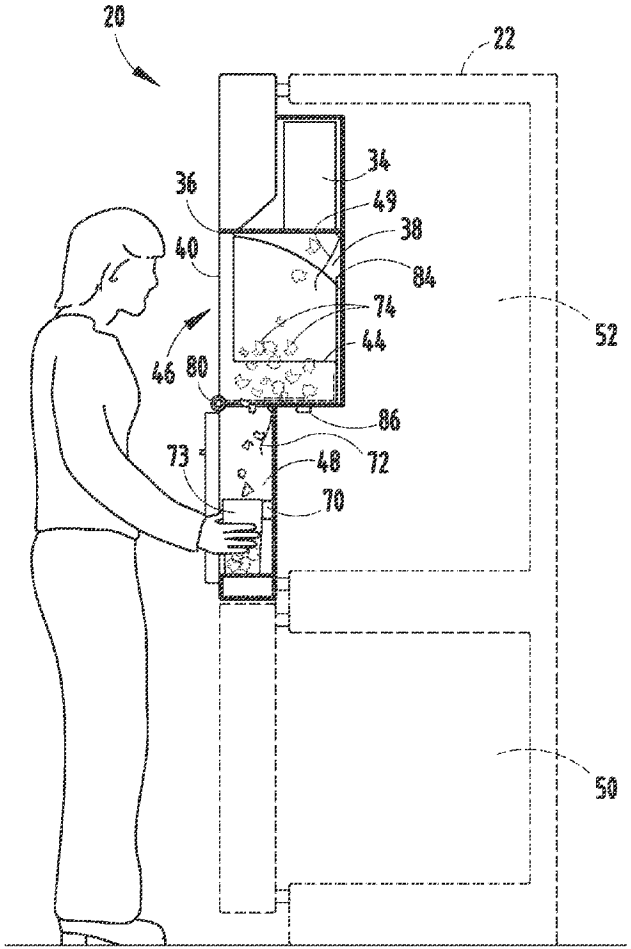
FIG. 4 is a side cross-sectional elevational view of the refrigerator of FIG. 3 dispensing ice.
Figure 3:
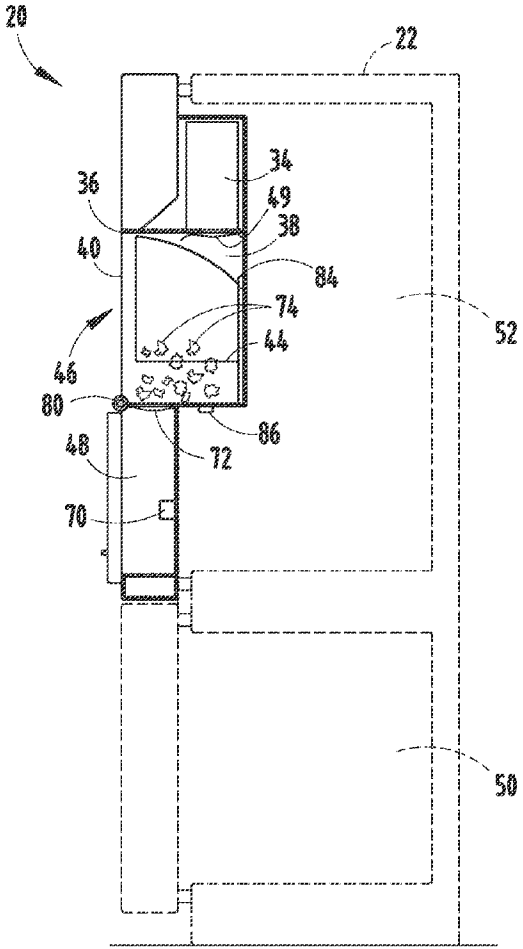
FIG. 3 is a side cross-sectional elevational view of the refrigerator of FIG. 1 taken at III.

Referring now to FIG. 3, the ice dispenser 48 of the illustrated embodiment is adjacent to and below the ice bucket 40. The ice dispenser 48 includes an actuator 70 that is operably linked to an ice hatch 72 in the reservoir portion 44 of the bucket 40. The actuator 70 may be connected by an electrical line that sends a control signal to a motorized device operably connected to the ice hatch 72. Alternatively, the actuator 70 may be operably connected with a mechanical linkage. More specifically, the actuator 70 may be linked by a mechanical linkage that causes the ice hatch 72 to open when the actuator 70 is engaged. It is contemplated that the actuator 70 and ice hatch 72 may be connected in a multitude of ways as understood by one having ordinary skill in the art. Engagement of the actuator 70, for example, by the drinking cup 73 of a user, causes the ice hatch 72 to open. When the ice hatch 72 opens, ice 74 cascades from the ice bucket 40 downward into the ice dispenser 48 and into the cup 73 of a user, as shown in FIG. 4. When the actuator 70 is disengaged, the ice hatch 72 closes thereby prohibiting ice 74 from leaving the bucket 40 and cascading downward into the ice dispenser 48.

Figure 6:
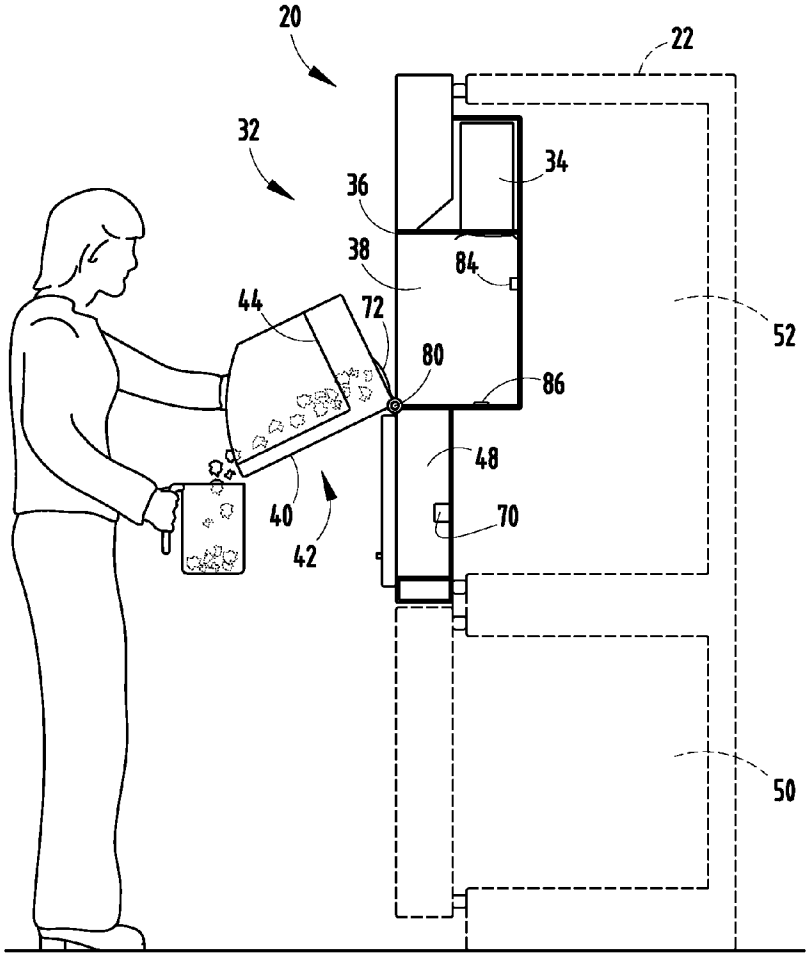
FIG. 6 is a side cross-sectional elevational view of the refrigerator of FIG. 3 with the bucket fully open.
Figure 5:
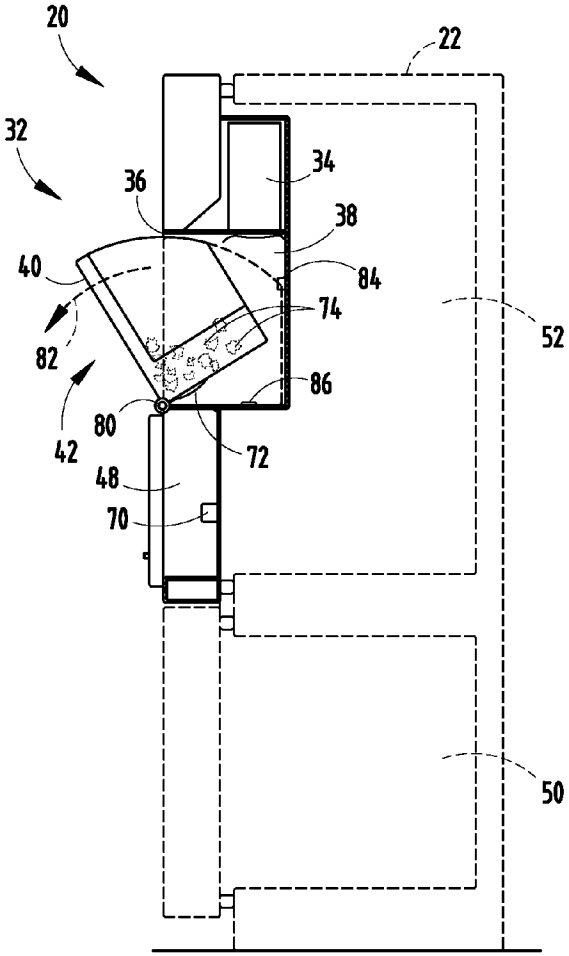
FIG. 5 is a side cross-sectional elevational view of the refrigerator of FIG. 3 with the bucket partially open.

Referring now to FIGS. 5 and 6, the ice bucket 40 includes a hinge 80 that allows downward rotational movement of the ice bucket 40 in the direction of arrow 82 about the hinge 80, such that the ice bucket 40 may be placed in an open lowered position to allow a large volume of ice 74 to be dispensed to a user. The ice bucket 40 includes a volume sensor 84 that sends a signal to the ice maker 34 when the ice 74 has reached a predetermined maximum volume. The volume sensor 84 may be a mechanical arm or an infrared eye, as shown in FIGS. 3-6, that measures the height of the ice 74 in the ice bucket 40. In addition, the ice bucket 40 includes a position sensor 86 that sends a signal to a controller that controls the ice maker 34 indicating that the ice bucket 40 is in the lowered position 42. When the ice bucket 40 is in the lowered position 42, the controller sends a signal to the ice maker 34 instructing the ice maker 34 not to release ice 74. When the ice bucket 40 returns to the closed or raised position 46, the controller receives a signal from the position sensor 86 that the ice bucket 40 is once again available to receive ice 74.

Figure 9:
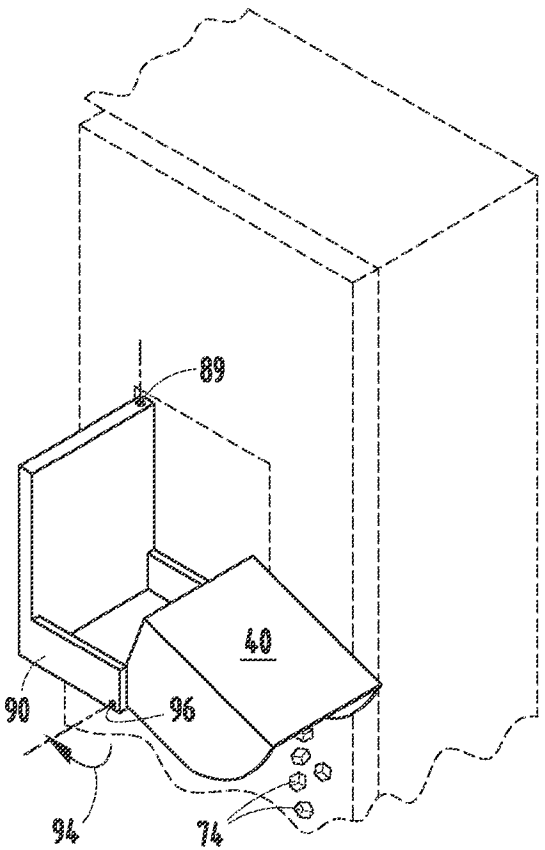
FIG. 9 is a top perspective view of the ice bucket assembly of FIG. 7 with the ice bucket rotated horizontally outward and vertically downward.
Figure 8:
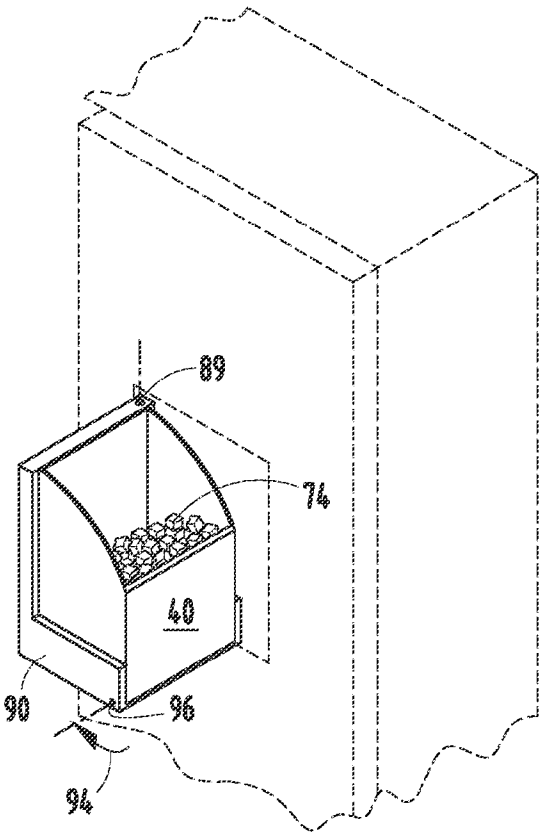
FIG. 8 is a top perspective view of the ice bucket assembly of FIG. 7 with the ice bucket rotated horizontally outward.
Figure 7:
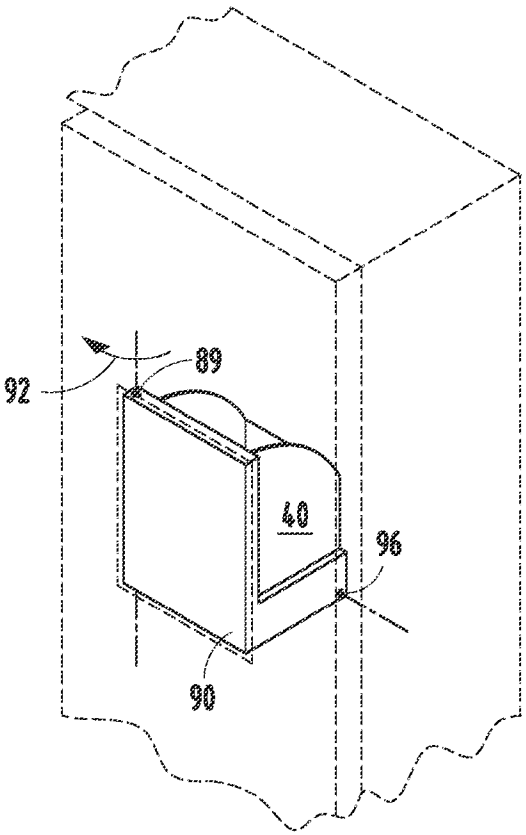
FIG. 7 is a top perspective view of another embodiment of an ice bucket assembly of the present invention.

Referring now to FIGS. 7-9, the illustrated embodiment includes an ice bucket 40 that is rotatable horizontally about hinge 89 in the refrigerator door 24 on a swing arm 90 in the direction of arrow 92. The swing arm 90 extends from the exterior side 28 of the refrigerator door 24. The ice bucket 40 is then rotatable vertically downward in the direction of arrow 94 about a horizontal hinge 96 on the swing arm 90.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A door assembly for a refrigerator comprising:

a door having an interior side and an exterior side, the door operable between an open position and a closed position;

an ice maker adjacent the interior side of the door when the door is in the closed position;

a frame defining an aperture extending from the interior side to the exterior side;

an ice bucket disposed in the aperture and operable between a lowered position, wherein a reservoir portion of the bucket is accessible when the door is closed, and a raised position, wherein the reservoir portion of the bucket is inaccessible when the door is closed;

a first ice hatch disposed between the ice maker and the ice bucket;

a second ice hatch disposed below the reservoir portion of the ice bucket; and an ice dispenser disposed below the ice bucket, wherein the ice bucket is attached to the frame proximate the exterior side of the door by the first hinge adapted for swinging the ice bucket about a vertical axis away from the door, and by a second hinge adapted for tilting the ice bucket downward about a horizontal axis such that stored ice can be dumped from the ice bucket.

2. The door assembly of claim 1, wherein the second ice hatch is operably linked with an actuator disposed in the ice dispenser.

3. The door assembly of claim 1, wherein the first hinge is defined by a horizontal swing arm hingedly attached with the bucket.

4. The door assembly of claim 1, further comprising:

a volume sensor that monitors the volume of ice in the ice bucket.

5. The door assembly of claim 1, further comprising:

a position sensor that monitors the position of the ice bucket.

6. A comprising:

a refrigerating section;

a freezing section;

a door hingedly connected to the refrigerator and operable between an open position and a closed position;

an ice maker disposed inside the refrigerating section; and an ice bucket operably coupled with an exterior side of the door, wherein the ice bucket receives ice from the ice maker and is horizontally rotatable relative to the door about a first hinge having a vertical axis, and vertically rotatable downward about a second hinge having a horizontal axis, such that tilting the ice bucket below the horizontal axis will dump ice out of the ice bucket when the door is in the closed position.

7. The refrigerator of claim 6, wherein the ice bucket includes an ice hatch disposed below the ice bucket.

8. The refrigerator of claim 7, further comprising:

an ice dispenser disposed below the ice hatch.

9. The refrigerator of claim 8, wherein the ice hatch is operably connected with an actuator disposed in the ice dispenser.

10. The refrigerator of claim 9, wherein the first hinge is defined by an outwardly-swinging lever arm hingedly attached with the ice bucket.

11. The refrigerator of claim 8, further comprising:

a volume sensor that monitors the volume of ice in the ice bucket.

12. The refrigerator of claim 8, further comprising:

a position sensor that monitors the position of the ice bucket.

13. A module for a refrigerator comprising:

an ice maker operably coupled with a first ice hatch;

a tilt-out ice bucket disposed below the ice maker and rotatably connected by a first hinge to an external side of the refrigerator for horizontally rotating the ice bucket about a vertical axis, the tilt-out ice bucket having a bottom wall with a second ice hatch disposed therein and a horizontal swing arm hingedly attached to the ice bucket for tilting the ice bucket about a horizontal axis, such that tilting the ice bucket below the horizontal axis will dump ice out of the ice bucket; and an ice dispenser having an actuator operably connected with and disposed below the ice hatch and adapted to receive ice from the tilt-out ice bucket upon engagement of the actuator.

14. The module of claim 13, further comprising:

a gasket disposed about a perimeter of the tilt-out ice bucket.

15. The module of claim 13, wherein the actuator is connected to a motorized device operably connected to the ice hatch.

16. The module of claim 13, wherein the actuator is operably connected to a mechanical linkage that is operably connected with the ice hatch.

* * * * *